United States Patent [19]

Mitchell

[11] 4,025,094

[45] May 24, 1977

[54] OVERCENTER LATCH

[75] Inventor: Thomas L. Mitchell, Washington, Ill.

[73] Assignee: Caterpillar Tractor Co., Peoria, Ill.

[22] Filed: Feb. 25, 1976

[21] Appl. No.: 661,089

[52] U.S. Cl. ..... 292/87; 292/DIG. 31; 292/DIG. 49; 292/DIG. 60

[51] Int. Cl.[2] ..... E05C 3/04

[58] Field of Search ..... 292/87–89, 292/63, 194, 256.71, 190, DIG. 31, DIG. 49, 76–79, 228, DIG. 30, DIG. 60

[56] References Cited

UNITED STATES PATENTS

| | | | |
|---|---|---|---|
| 1,700,907 | 2/1929 | Reichert | 292/DIG. 49 |
| 2,117,192 | 5/1938 | McClung | 292/DIG. 31 |
| 2,304,144 | 12/1942 | Borchers | 292/DIG. 31 |
| 2,762,641 | 9/1956 | Gilmour | 292/63 |
| 3,659,886 | 5/1972 | Andrews | 292/DIG. 49 |

*Primary Examiner*—Richard E. Moore
*Attorney, Agent, or Firm*—Phillips, Moore, Weissenberger, Lempio & Majestic

[57] ABSTRACT

A latch assembly is disclosed which is operative to retain a movable closure member in position with respect to an adjacent fixed wall member, and includes a handle member pivotally mounted to the closure member with an arm extending generally along the handle member beyond the pivotal mounting thereof for engaging the fixed wall member at one end thereof. An adjustable member is mounted on the end of the arm for adjusting the engagement of the end of the arm with respect to the wall member. An overcenter tension member is pivotally connected at one end to the closure member and the other end to the arm for biasing the arm into tight engagement with the fixed wall member when the latch is in the latched position.

4 Claims, 4 Drawing Figures

OVERCENTER LATCH

BACKGROUND OF THE INVENTION

This present invention relates to latch mechanisms and pertains particularly to an overcenter latch mechanism.

Compartment and container doors and covers require latch mechanisms that permit easy and ready access to the contents thereof and at the same time securely latch the cover or door into that closed position. Latch mechanisms for doors on compartments and the like on vehicles must be reliable and rugged and must contain some provision for eliminating rattling or loosening of the doors.

Many types and designs of latch mechanisms are known, however, many of them have one or more drawbacks which prevent their satisfactory utilization for vehicle compartments and the like.

SUMMARY AND OBJECTS OF THE INVENTION

Accordingly, it is the primary object of the present invention to overcome the above problems of the prior art.

Another object of the present invention is to provide a latch mechanism that is rugged and reliable and includes means for eliminating looseness therein.

In accordance with the primary aspect of the present invention, a latch mechanism includes a latch handle pivotally connected at one end to a closure member and including an arm extending therefrom with adjustable means at the end thereof for engaging an adjacent fixed wall member. An overcenter tension member means biases the arm into engagement with the fixed member when the latch assembly is in the latch position.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
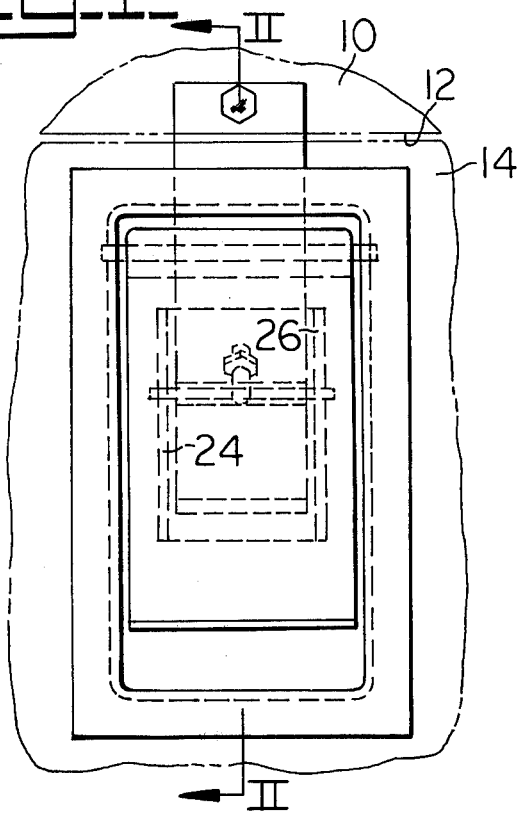
FIG. 1 is a plan view of a latch mechanism in accordance with the present invention.

Turning now to the drawings, particularly FIG. 1, there is illustrated a latch assembly for latching a closure member such as a door or cover into position for closing and opening a wall of a compartment or container. As best seen in FIG. 1, a compartment or container is defined by fixed walls 10 which are also formed to define an opening 12 which opening is closed by means of a movable closure member 14. The closure member 14 may be a removable cover or it may simply be a door or the like pivotally connected such as by suitable hinge means 16 to the fixed wall means 10 of the container or the like.

The latch assembly comprises a generally box-shaped wall member 18 defining a generally rectangular cavity 20 for receiving or mounting the latch assembly. The wall member 18 defines a generally rectangular opening 20 having a pair of upturned flange members 22 and 24 extending along the side thereof. The box-shaped wall member 18 is further mounted within an opening or a rectangular-shaped opening 28 within the walls of the closure member 14.

A flat generally rectangular-shaped latch handle is pivotally connected or mounted at its upper end by pin means 32 to the box-shaped member 18 and is disposed substantially within the cavity 20 thereof and substantially within the plane of the fixed walls 10 and the walls 18 of the closure member 14. The handle member 30 substantially covers the opening of the cavity 20 with sufficient clearance at the lower end thereof for receiving the fingers of an operator for grasping the lower end 30*a* of the handle. The handle includes a portion 34 turned up slightly to facilitate grasping of the fingers by an individual.

A generally C-shaped arm member 34 is secured at one end to the latch member 30 and extends substantially therealong through opening 22 of wall 18 and upwards beyond the pivot pin 32 with an upper end 36 carrying an adjustable means in the form of a bolt 38 for engaging the fixed wall 10. The member 34 is preferably a flat substantially rectangular spring member in plan view for tightly engaging the wall member 10 for retaining the closure member 14 in place in tight engagement. This tight engagement prevents rattling of the closure member.

The spool or bolts 38 includes a lock nut or the like 40 for retaining the bolt in position. The bolt 38 may be adjusted along its length toward and away from the wall 10 for adjusting the bias of the member 34 thereon and thus the engagement of the head of the bolt 38 with the wall 10. An overcenter tension member 42 is pivotally connected at one end by pivot pin means 44 to the flanges 24 and 26 adjacent opening 22 and extends at the other end through an opening 46 of the arm member 34 and is connected thereto. A nut or the like 48 is threadably mounted on the outer end of the tension member 42 for adjusting the length of the link 42 and thereby tension thereof on the arm member 34.

Figure 2:
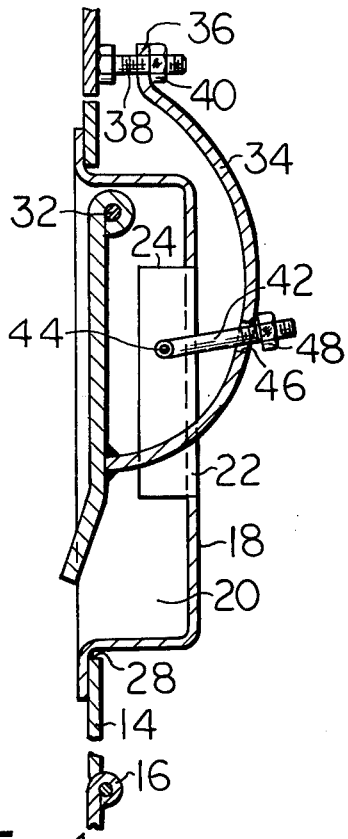
FIG. 2 is a sectional view taken generally along lines II—II of FIG. 1 with the latch in the latched position.
Figure 3:
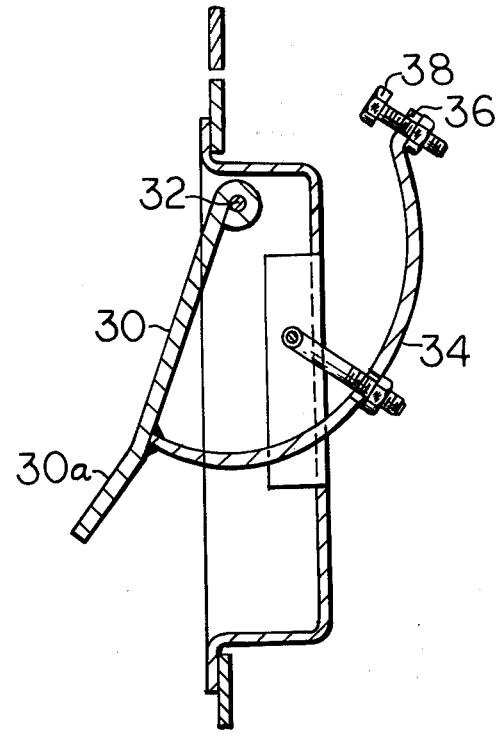
FIG. 3 is a view like FIG. 2 with the latch in the unlatched position.

The geometric configuration of the combined linkage means defined by the handle 30, the arm 34 and the link 42 is such that link 42 acts as an overcenter tension member for applying tension or force to the arm 34 when the assembly is in the latched position as shown in FIG. 2, and relaxes or releases the tension thereon when the latch is in the unlatched position as shown in FIG. 3. It will be appreciated from the geometry that the pivot pin 44 of the tension member 42 is offset from the pivot pin 32 and the plane of the handle 30. The arm 34 curves around the axis of both ends and the connection thereto of member 42 describes a fixed arc or path about pivot 44 and a changeable arc or path about the pin 32 thus forcing the outer end of arm 34, 36 toward the frame member 10 when handle 30 is moved toward the pivot pin 44.

Figure 4:
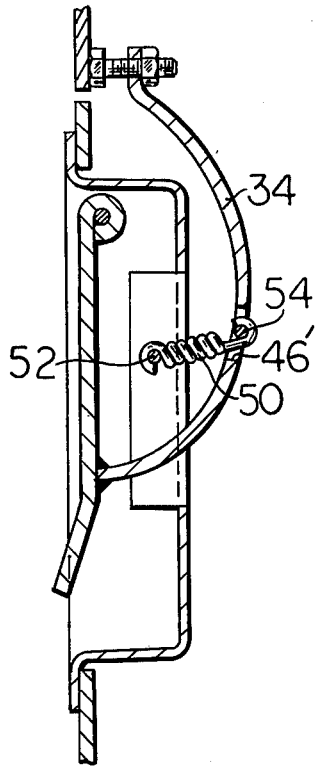
FIG. 4 is a view like FIG. 2 of an alternate embodiment of the invention.

Turning now to FIG. 4, an alternate configuration or embodiment is shown wherein the overcentered tension member comprises a tension spring 50 which is pivotally connected at one end to a pin 52 mounted in the bracket members 24 and 26 and pivotally connected at the other end to a pin 54 defined or mounted in an opening 46 of the arm 34. In this embodiment, the spring may be provided primarily by the spring 50 and/or the spring may be provided by a combination of the spring 50 and the arm member 34. In contrast, in the previous embodiment, the spring must be provided entirely by the member 34.

Thus, from the above description, it is seen that I have provided a novel overcenter latch mechanism for doors and closure members. While the invention has been described and illustrated by means of specific embodiment, it is to be understood that numerous changes and modifications may be made therein without departing from the spirit and scope of the invention as defined in the appended claims herein.

I claim:

1. An overcenter latch assembly for latching a movable closure member to a fixed wall member comprising in combination:

a fixed wall member having an opening defined therein;

a movable closure member pivotally secured to said fixed wall member and pivotal to a first position for closing said opening and pivotal to a second position for clearing said opening;

latch means carried by said movable member and movable to a position for engaging said fixed wall member for retaining said pivotal wall member into position in said opening, said latch means comprising:

a handle member having a generally flat rectangular configuration, said handle member pivotally mounted at one end to said movable closure member adjacent a plane defined thereby;

an arm member formulated of spring material secured at one end to said handle member and extending generally along said handle to another end located beyond the pivotal mounting of the handle to the movable closure member;

adjustable means mounted on said other end of said arm member for adjustably engaging the fixed wall member and setting up an adjustable spring tension in said arm member when said latch means retains said pivotal closure member in said first position;

a cavity defined by wall means of said closure member for receiving said handle member; and an overcenter tension member pivotally connected at one end to said wall means of said closure member intermediate said pivotal mounting of said handle member to said movable closure member and said arm member and pivotally connected at the other end to said arm member.

2. The latch assembly of claim 1 wherein said arm member is of a generally C configuration, curved about the pivotal axis of said handle member.

3. The latch assembly of claim 1 wherein said overcenter tension member is adjustable in length.

4. The latch assembly of claim 1 wherein said overcenter tension member is a tension spring.

* * * * *